United States Patent [19]

Terashima

[11] 4,342,283

[45] Aug. 3, 1982

[54] DEVELOPING APPARATUS FOR ELECTROSTATIC DUPLICATOR

[75] Inventor: Isamu Terashima, Hitachi, Japan

[73] Assignee: Hitachi, Ltd., Tokyo, Japan

[21] Appl. No.: 209,114

[22] Filed: Nov. 21, 1980

[30] Foreign Application Priority Data

Nov. 24, 1979 [JP] Japan ..... 54-151327

[51] Int. Cl.[3] ..... B05B 5/02; G03G 15/09

[52] U.S. Cl. ..... 118/689; 118/620; 118/657; 355/3 DD

[58] Field of Search ..... 118/689, 657, 658, 620; 355/3 DD

[56] References Cited

U.S. PATENT DOCUMENTS

| | | | |
|---|---|---|---|
| 3,572,551 | 3/1971 | Gillespie | 222/56 |
| 3,802,381 | 4/1974 | O'Neil et al. | 118/7 |
| 3,999,687 | 12/1976 | Baer et al. | 222/52 |
| 4,131,081 | 12/1978 | Terashima | 118/9 |

*Primary Examiner*—Bernard D. Pianalto

*Attorney, Agent, or Firm*—Craig and Antonelli

[57] ABSTRACT

A developing apparatus is provided in which the toner concentration of a developing agent for electrostatic duplicator is detected with high precision by positively magnetizing the developing agent present in the detection region in a toner concentration detecting container. The developing agent within the detecting container is magnetized within a range of a magnetic flux density under which the permeability is not so changed with the change of magnetic field, even if a change of the magnetic flux of a magnetic roll or the like is produced.

5 Claims, 7 Drawing Figures

DEVELOPING APPARATUS FOR ELECTROSTATIC DUPLICATOR

The present invention relates to a developing apparatus used for duplicators, printers, facsimiles and the like in which an electrostatic latent image on a recording medium is developed by a developing agent comprising the mixture of a magnetic carrier and a nonmagnetic toner, and particularly this invention relates to a toner concentration detecting apparatus therefor.

There has been proposed a method of detecting the mixture ratio of a magnetic carrier and nonmagnetic toner which constitute a developing agent conducted into a detecting container, or detecting the toner concentration (weight ratio) of the developing agent therein. For example, U.S. Pat. Nos. 4,131,081, 3,802,381, 3,572,551 and 3,999,687 are disclosed.

In the U.S. Pat. No. 3,572,551, a bypass for permitting part of the developing agent to pass for measurement of the toner concentration is provided at the bottom of the container in which the developing agent is placed. In the U.S. Pat. Nos. 3,802,381 and 3,999,687, the measurement of the toner concentration is performed while part of the developing agent is being passed through the toner concentration detecting container having a flowing-out cross-section smaller than the flowing-in cross-section through which the developing agent is flowing in. In the U.S. Pat. No. 4,131,081, there are shown means for magnetizing the developing agent located at the flowing-out portion of the toner concentration detecting container by use of the flux from the magnet roll.

In such toner concentration detecting apparatus, however, when the developing agent of fine grain powder is flowing through the detecting container, the powder is sometimes pressed and compressed by the external vibration so as to choke the container by a bridge effect. In addition, the temperature rise of the developing apparatus and the moisture absorption of the developing agent under a high-humidity atmosphere change the flow characteristics of the developing agent, providing results different from those in the static measurement, and this leads to a chocking phenomenon. This tendency to the different detection becomes more pronounced particularly when the developing agent is of a high concentration, or high toner ratio, or when the carrier is of fine grain (50$\mu$ or below).

Moreover, since the permeability of the magnetic developing agent depends on the strength of the magnetization, the magnitude of the leakage flux from the generally used magnetic carrier means, or magnet roll is changed by the toner concentration of the developing agent: that is, when the concentration is low, the carriers come closer to each other to increase the permeability, and the developing agent attached to the magnet roll decreases the magnetic reluctance of the magnetic circuit to decrease the leakage flux near the magnet roll. In addition, since the magnetic flux is changed by the temperature characteristics and secular variation of the permanent magnet constituting the magnet roll, the developing agent in the detecting container which is provided within the vessel in which the developing agent is placed is changed in the strength of its magnetization.

The choking and magnetization variation phenomena of the developing agent as described above have not been solved yet.

It is an object of the present invention to provide a developing apparatus wherein the above drawbacks are obviated, choking of the developing agent is eliminated from a container for detecting a toner concentration, and the toner concentration can be detected with high accuracy.

The feature of this invention for achieving this object resides in positively magnetizing a developing agent within the detecting region near a permeability detecting means in a detecting container, and further resides in the fact that the developing agent within the detecting region is magnetized within a region of a magnetic density such that the permeability is not greatly changed with the magnetic field, preferably with 50 to 200 gauss, even if a change of the magnetic flux of a magnetic roll or the like is produced.

This prevents the developing agent from being choked by the bridge effect in the detecting container due to, for example, external vibration, and enables only change of the permeability due to the toner concentration to be detected with high precision.

The present invention will now be described by way of example with reference to the accompanying drawings in which:

DETAILED DESCRIPTION OF THE DRAWINGS

Figure 1:
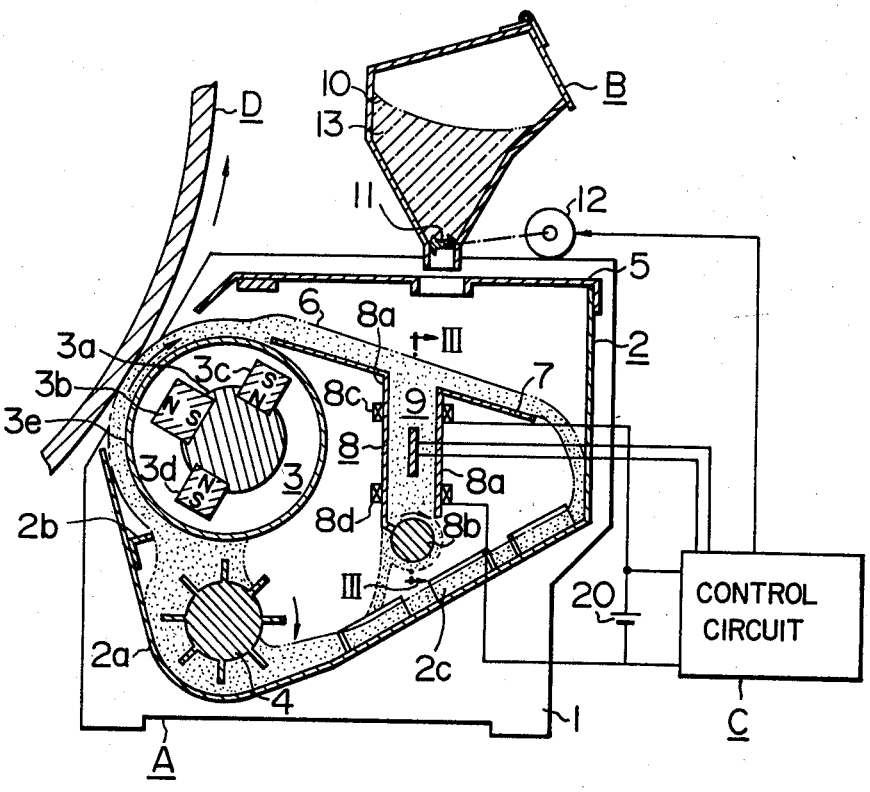
FIG. 1 is a schematic cross-section of the developing apparatus for one embodiment of the invention.

Referring to FIG. 1, there are shown side plates 1 and a container 2 for a developing agent. The container 2 is formed of the side plates 1 and a bottom plate 2*a*. On the bottom plate 2*a* is mounted an agitating plate 2*c* for increasing the effect of mixing a developing agent 6. The agitating plate 2*c* is arranged in such a manner as to divide the flow of the developing agent 6 when it flows down the slope of the bottom plate 2*a*, and to interchange the divided flows alternately. On the bottom plate 2*a* is also a regulating plate 2*b* for controlling the amount of the developing agent 6 carried by a magnetic roll 3. The magnetic roll 3 is formed of rectangular magnets 3*b* to 3*d* which are mounted on a magnet support 3*a* secured to the side plates 1, and a nonmagnetic sleeve 3*e* rotatably supported by the support 3*a*. This sleeve 3*e* is rotated, upon the developing process, in the arrow direction by a power source not shown, so as to develop an electrostatic latent image on the surface of a photosensitive drum D.

An auxiliary transporter 4 is provided for carrying the developing agent 6 in the container to the magnetic roll 3, and rotatably mounted on the side plates 1. This transporter 4 is rotated in synchronism with the sleeve 3*e* by a power transmitting link which, although not shown, connects the transporter 4 to the sleeve 3*e*.

Figure 3:
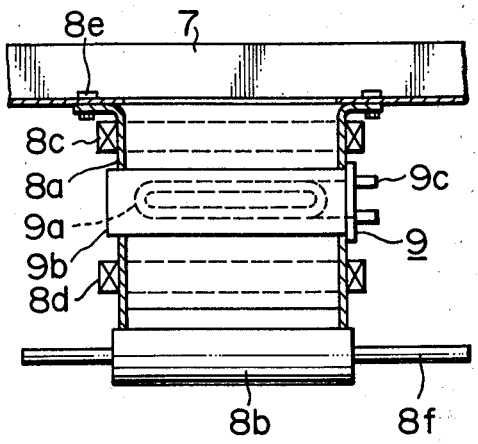
FIG. 3 is a cross-section taken along line III—III in FIG. 1, for showing the toner detecting means.

Shown at 5 is a cover having at its center an aperture for supplying the toner, and 7 a guide plate for separating the used developing agent 6 from the sleeve 3*e*, and guiding part of the separated developing agent to a concentration detecting portion 8 and the other part thereof to the agitating plate 2*c*. The concentration detecting portion 8 is formed of a nonconducting detecting container 8*a* which is secured to the upper portion of the guide late 7 by setscrews 8*e* as shown in FIG. 3; a sensor unit 9 mounted within the detecting container 8*a* and its side planes being positioned in the direction of the flow of the developing agent 6 passing the container 8*a*; magnetizing coils 8*c* and 8*d* wound around the developing agent 6 within the detecting container 8*a*, which agent being located as a magnetic core, for magnetizing the agent in the direction of the flow thereof; and a small-sized magnetic roll 8*b* secured to a shaft 8*f* which is rotatably supported to the side plates 1 at the lower portion of the detecting container 8*a* where the developing agent 6 is flowing out and which is rotated in synchronism with the sleeve 3*e*. The sensor unit 9 is formed of a flat wound coil 9*a* packaged in a plate-like shape by a resin mold 9*b* with the ends of the coil 9*a* being connected to terminals 9*c*. The coil 9*a* is connected to a control circuit C, and the magnetizing coils 8*c* and 8*d* to a DC power supply 20.

Figure 2:
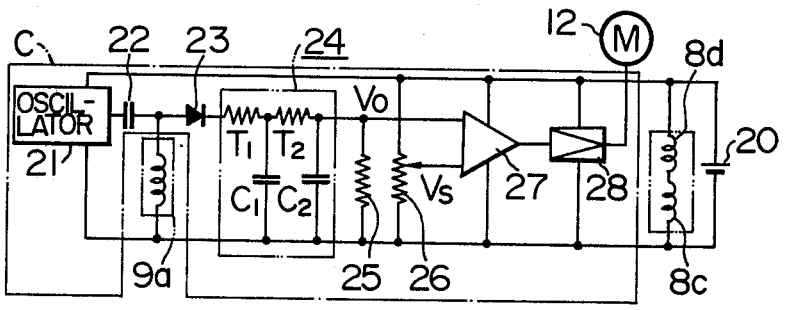
FIG. 2 is a diagram of the control circuit for use in the developing apparatus.

The control circuit C is connected to the power supply 20, and includes such elements as shown in FIG. 2. The output of an oscillator 21 is connected through a coupling capacitor 22 to the coil 9*a*. The capacitor 22 and the coil 9*a* are coupled substantially in series resonance condition. The voltage across the coil 9*a* is applied to a smoothing circuit 24 consisting of a diode 23, capacitors $C_1$ and $C_2$ and resistors $r_1$ and $r_2$. The smoothing circuit 24 produces at its output a concentration indicating voltage $V_o$. Shown at 25 is a dividing resistance for changing the indicating voltage $V_o$ to an appropriate value within the power supply voltage, and 26 a potentiometer for obtaining a reference voltage $V_s$ relative to the known reference toner concentration output voltage $V_o$. Numeral 27 represents a comparator having a suitable hysteresis voltage, which produces an output signal in response to the toner concentration indicating voltage smaller than the reference toner concentration. This signal is power-amplified by an amplifier 28 and then applied to a toner supply motor 12.

A toner supply apparatus B is provided which, as shown in FIG. 1, is formed of a hopper 10, a supply gear 11 driven by the motor 12 which is rotatably mounted at the lower portion of the hopper, and a supply toner 13 placed in the hopper 10.

The operation of this developing apparatus will hereinafter be described.

The developing agent 6 within the container 2 is transported to the magnetic roll 3 by the auxiliary transporter 4 and adhered to the surface of the sleeve 3*e* by the magnetic force of the magnets 3*b* to 3*d*. The sleeve 3*e* is rotated to carry the developing agent to the surface of the photosensitive drum D. Thus the electrostatic latent image on the surface of the drum D is developed by the toner. The developing agent 6, after used to develop the image, is partially carried to the toner concentration detecting portion 8*a* by the guide plate 7, and the other part of the developing agent 6 is guided thereby to the bottom plate 2*a*. The part of developing agent at the bottom plate 2*a* is divided in its flow by the agitating plate 2*c* while it is flowing down along the slope of the bottom plate 2*a*. Then, the flowing-down developing agent is again carried back to the surface of the photosensitive drum D by the auxiliary transporter 4 and magnetic roll 3, and repeats the previous developing process. The repetition of the process gradually reduces the toner concentration in the developing agent.

On the other hand, the developing agent 6 conducted by the guide plate 7 to the concentration detecting portion 8*a* fills the detecting region of the detecting container 8*a*. The developing agent 6 therein is gradually carried by the rotation of the small-sized magnetic roll 8*b* to the outside of the container 8*a*. Thus, the permeability of the developing agent 6 under the constant circulating flow is detected by the inductance of the coil 9*a* in the sensor unit 9. The change of the inductance will change the resonant condition of the coupling capacitor 22 and the inductance to change the voltage across the coil 9*a*, resulting in the change of the indicating voltage $V_o$. If, now, the toner concentration is decreased as the developing process progresses, the toner supply signal is generated to make the supply motor 12 rotate, on the basis of the comparison with the reference concentration voltage $V_a$. Consequently, the toner 13 is supplied from the hopper 10 to keep the toner concentration in the developing agent constant.

However, if a mechanical vibration or shock is given to the developing apparatus by an external cause, the developing agent 6 in the container 8*a* increases in apparent density. As a result, the permeability thereof increases to cause the control circuit C to generate an erroneous signal.

Figure 4:
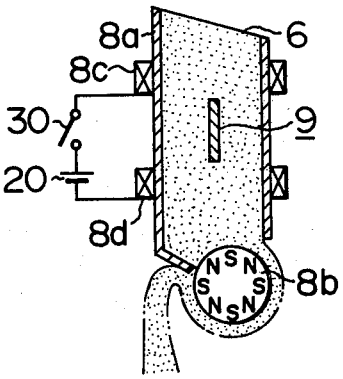
FIGS. 4 and 5 are cross-sections of the concentration detecting portion for showing the states of the developing agent upon nonmagnetization and magnetization, respectively.

FIG. 4 shows the state of the concentration detecting portion of the invention, that is, the state in which no current is flowing through the magnetizing coils 8*c* and 8*d*. The developing agent 6 under this condition uniformly fills the container as if the normal grains exhibited that condition. Therefore, the external vibration or shock to the developing apparatus will cause the apparent volume reduction of the developing agent as if the container filled with sand were merely tapped. Consequently, the density thereof is increased. This external cause not only changes the density but also the fluid property of the developing agent is remarkably changed. In other words, normal flow is hindered and in the worst case a choking phenomenon develops stopping the flow. This tendency becomes more pronounced particularly at high humidity, high temperature and high concentration, and is the stronger the smaller the carrier grain size.

Figure 5:
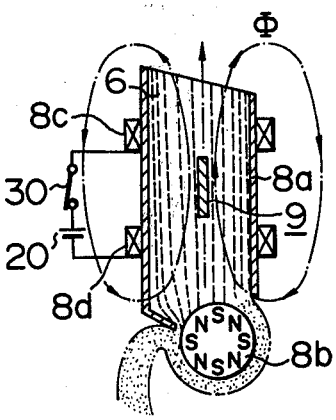

FIG. 5 shows the concentration detecting portion of this embodiment with the switch 30 turned on to permit current to flow into the magnetizing coils 8*c* and 8*d* which are distributively wound on the detecting container 8*a*. Under this condition, the developing agent 6 within the detecting container 8*a* causes a magnetic chain phenomenon between its grains in accordance with the intensity of current or magnetization and comes to have magnetic brush. This binding force becomes strong in accordance with the strength of the magnetization to prevent the variation of the density due to the external vibration and shock.

However, when the magnetization is unnecessarily strengthened, the fluid property is no longer kept.

According to an experiment using the developing agent with the toner concentration of 2 to 8 weight %, carrier diameter of about 80$\mu$ and toner diameter of about 8$\mu$, natural fall occured under about 200 gauss or below of magnetic flux within the container of 12 mm×50 mm in cross-section and 40 mm in vertical length.

The leakage flux from the magnetic roll 3 is about 20 to 30 gauss in the region in which the detecting container exists and which is located opposite to the magnetic brush. The magnetic flux density within the detecting container is the sum of the leakage magnetic flux density from the magnetic roll and the magnetic flux density due to the positive magnetizing coils 8*c* and 8*d*.

Figure 6:
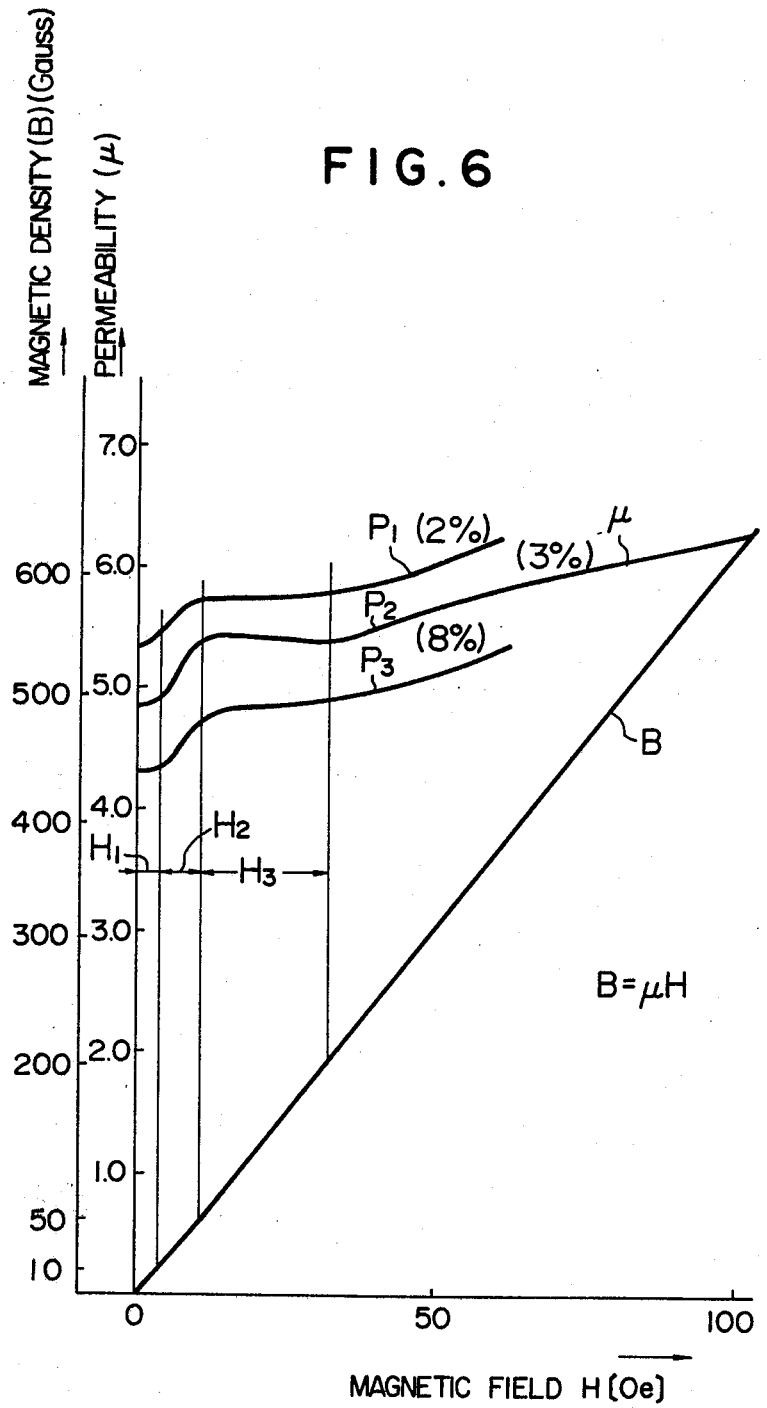
FIG. 6 is a graph of the magnetization characteristics of the developing agent.

FIG. 6 shows the magnetization characteristic of the developing agent. The curve of the permeability, $\mu$ relative to the magnetic field, H is drawn in accordance with the equation, $B=\mu H$. The permeability curves $P_1$ to $P_3$ are for the toner concentrations of 2, 3, and 8 weight %, respectively. From the permeability curves it will be seen that the curves are flat in the ranges $H_1$ and $H_3$ of magnetic field, that is, the permeability is little changed with the change of magnetic field in these ranges. In the range, $H_2$ the permeability is greatly changed with the magnetic field.

When the toner concentration is intended to be detected by detecting the change of the permeability of the developing agent, since the change of the generated magnetic field due to the change of the magnetic roll temperature and the secular variation of the magnetic roll (for example, the magnetic force being reduced about 1% per 1 year) will change the permeability as described above, it is difficult to accurately measure the change of permeability dependent only on the toner concentration. In other words, when the permeability change depending only upon the toner concentration is sought to be measured, it is undesirable that there occur the permeability change due to the factors other than the toner concentration, or the temperature change and secular variation as described above. In order to avoid this, the present invention is to magnetize the developing agent in the predetermined region within a region of a magnetic density such that the permeability is not so changed with the change of magnetic field, even if a change of the magnetic flux of the magnetic roll occurs. The flat regions of the curves are the two regions $H_1$ and $H_3$ as seen from FIG. 6, but the region of $H_1$ is difficult to use for the following reason. The range of $H_1$ is near zero field, and thus realization of $H_1$ needs a long-distance separation of the detecting container from the magnetic roll 3 because the magnetic roll establishes a strong magnetic field. Accordingly, the developing apparatus becomes large sized.

From the above consideration, the developing agent within the detecting container is magnetized to the magnetic density of about 50 to 200 gauss (in the range of $H_3$), even if a change of the magnetic flux of the magnetic roll or the like is produced, so that the accuracy of detection by the concentration detector is not reduced by the leakage magnetic flux from the magnetic roll 3 due to the external mechanical vibration, temperature change and secular variation and choking only occurs with difficulty in the concentration detector. Experiments have shown that the optimum magnetic flux density is about 100 gauss. Moreover, it is unnecessary to continuously supply current to the coils 8*c* and 8*d*, but current supply thereto only upon detection will provide the same effect.

While in the embodiment of FIG. 1, the coils 8*c* and 8*d* are provided as positive magnetizing means, the coils 8*c* and 8*d* may be replaced by a permanent magnet, which is located at the outside of the detecting container so that the sum of the magnetic flux from the permanent magnet and the leakage flux from the magnet roll 3 becomes about 50 to 200 gauss within the detecting container.

Figure 7:
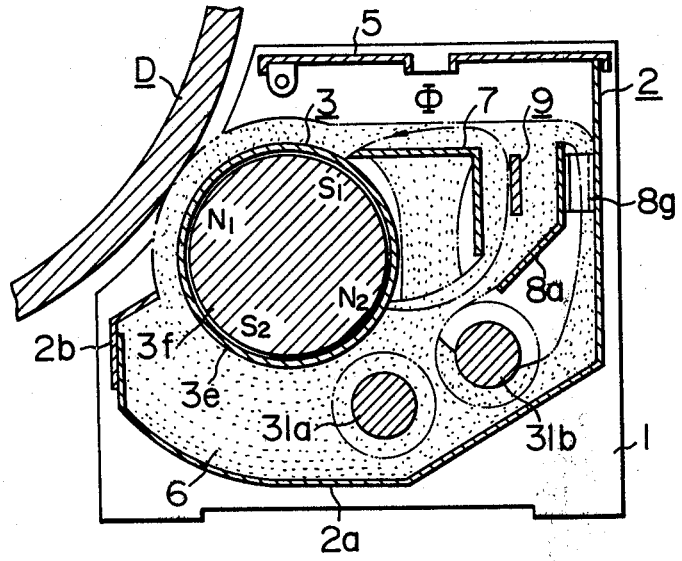
FIG. 7 is a schematic cross-section of the developing apparatus of another embodiment of the invention.

FIG. 7 is a cross-section of the developing apparatus of another embodiment of the invention, in which like elements corresponding to those of FIG. 1 are identified by the same reference numerals.

In this embodiment, the magnetizing coils 8*c* and 8*d* are omitted, and a magnetic roll 3*f* having a magnetized pattern different from that of FIG. 1 is used. Magnetic poles $N_1$ and $S_2$ produce a strong magnetic flux density of, for example, about 700 gauss. The magnetic flux $\phi$ generated between the magnetic poles $N_2$ and $S_1$ passes the detecting container 8*a*, providing a magnetic flux density of about 50 to 200 gauss therein. This magnetic flux $\phi$ serves to magnetize the developing agent within the detection region in the container 8*a* in its flow direction. In this illustration, 8*g* represents a mounting member for the detecting container, 31*a* and 31*b* agitation screws.

Thus, in accordance with this embodiment, the same effect as in the previous embodiment can be achieved, and the construction is simplified by omitting the magnetizing coils, with the choking phenomenon prevented even when the power supply is off.

What is claimed is:

1. A developing apparatus for electrostatic duplicator comprising:

a developing agent including a magnetic carrier and a nonmagnetic toner;

a container in which said developing agent is placed;

means for transporting the developing agent in said container to an electrostatic latent image surface of a recording medium;

means for passing part of said developing agent into a detecting container;

means for detecting permeability of the developing agent passing in the detecting container; and means for magnetizing the developing agent within a detection region in said detecting container in the direction of flow of the developing agent and within the range of a magnetic flux density such that the permeability of the developing agent is little changed with a change in the magnetic field whereby the developing agent is allowed to pass readily through the detection region.

2. A developing apparatus for electrostatic duplicator according to claim 1, wherein said magnetizing means includes permanent magnets placed at the outside of the detecting container.

3. A developing apparatus for electrostatic duplicator according to claim 1, wherein said magnetic flux density is in the range from about 50 to 200 gauss.

4. A developing apparatus for electrostatic duplicator according to claim 1, wherein said magnetizing means includes an electromagnetic coil provided on the outer peripheral surface of said detecting container.

5. A developing apparatus for electrostatic duplicator according to claim 2, wherein said transporting means includes a magnetic roll having a transporting magnetic pole and a magnetizing magnetic pole magnetized.

* * * * *